US011166518B2

(12) United States Patent
Watson

(10) Patent No.: US 11,166,518 B2
(45) Date of Patent: Nov. 9, 2021

(54) MOTORIZED SHOE ASSEMBLY

(71) Applicant: Roffes LeeAntoine Watson, Inkster, MI (US)

(72) Inventor: Roffes LeeAntoine Watson, Inkster, MI (US)

( * ) Notice: Subject to any disclaimer, the term of this patent is extended or adjusted under 35 U.S.C. 154(b) by 39 days.

(21) Appl. No.: 16/538,016

(22) Filed: Aug. 12, 2019

(65) Prior Publication Data

US 2021/0045489 A1 Feb. 18, 2021

(51) Int. Cl.

| | |
|---|---|
| ***A43B 3/00*** | (2006.01) |
| ***A43B 13/14*** | (2006.01) |
| ***A43B 5/16*** | (2006.01) |

(52) U.S. Cl.

CPC ..... *A43B 3/0005* (2013.01); *A43B 5/16* (2013.01); *A43B 13/14* (2013.01)

(58) Field of Classification Search

CPC ..... A43B 3/0005; A43B 5/16; A43B 13/14
See application file for complete search history.

(56) References Cited

U.S. PATENT DOCUMENTS

| | | | | |
|---|---|---|---|---|
| 5,236,058 | A * | 8/1993 | Yamet | A63C 17/12 180/181 |
| 6,050,357 | A * | 4/2000 | Staelin | B60L 3/0092 180/65.1 |
| 7,900,731 | B2 * | 3/2011 | McKinzie | A63C 17/12 180/181 |
| 8,006,795 | B2 * | 8/2011 | Manor | A43B 3/0005 180/181 |
| 10,926,160 | B2 * | 2/2021 | Micacchi | A43B 3/0005 |
| 2011/0057400 | A1 * | 3/2011 | Wills | A63C 17/20 280/11.203 |

* cited by examiner

*Primary Examiner* — Steven O Douglas

(57) ABSTRACT

A motorized shoe assembly includes an electronic device, such as a smart phone or the like, that is carried by a user. A shoe is provided and the shoe is worn on the user's foot, and the shoe has a sole and a heel. A first roller is rotatably coupled to the sole of the shoe for rolling on the support surface. A second roller is rotatably coupled to the sole of the shoe and the second roller is aligned with the heel. Moreover, the second roller is spaced upwardly from the support surface when the sole rests on the support surface. Alternatively, both of the first and second rollers engage the support surface when the shoe is tilted rearwardly onto the heel. A motor is positioned within the shoe and the motor is in mechanical communication with the second roller. The motor rotates the second roller when the motor is turned on to urge the user along the support surface.

7 Claims, 8 Drawing Sheets

MOTORIZED SHOE ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shoe devices and more particularly pertains to a new shoe device having a motorized roller for transporting a user.

BRIEF SUMMARY OF THE INVENTION

An embodiment of the disclosure meets the needs presented above by generally comprising an electronic device, such as a smart phone or the like, that is carried by a user. A shoe is provided and the shoe is worn on the user's foot, and the shoe has a sole and a heel. A first roller is rotatably coupled to the sole of the shoe for rolling on the support surface. A second roller is rotatably coupled to the sole of the shoe and the second roller is aligned with the heel. Moreover, the second roller is spaced upwardly from the support surface when the sole rests on the support surface. Alternatively, both of the first and second rollers engage the support surface when the shoe is tilted rearwardly onto the heel. A motor is positioned within the shoe and the motor is in mechanical communication with the second roller. The motor rotates the second roller when the motor is turned on to urge the user along the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
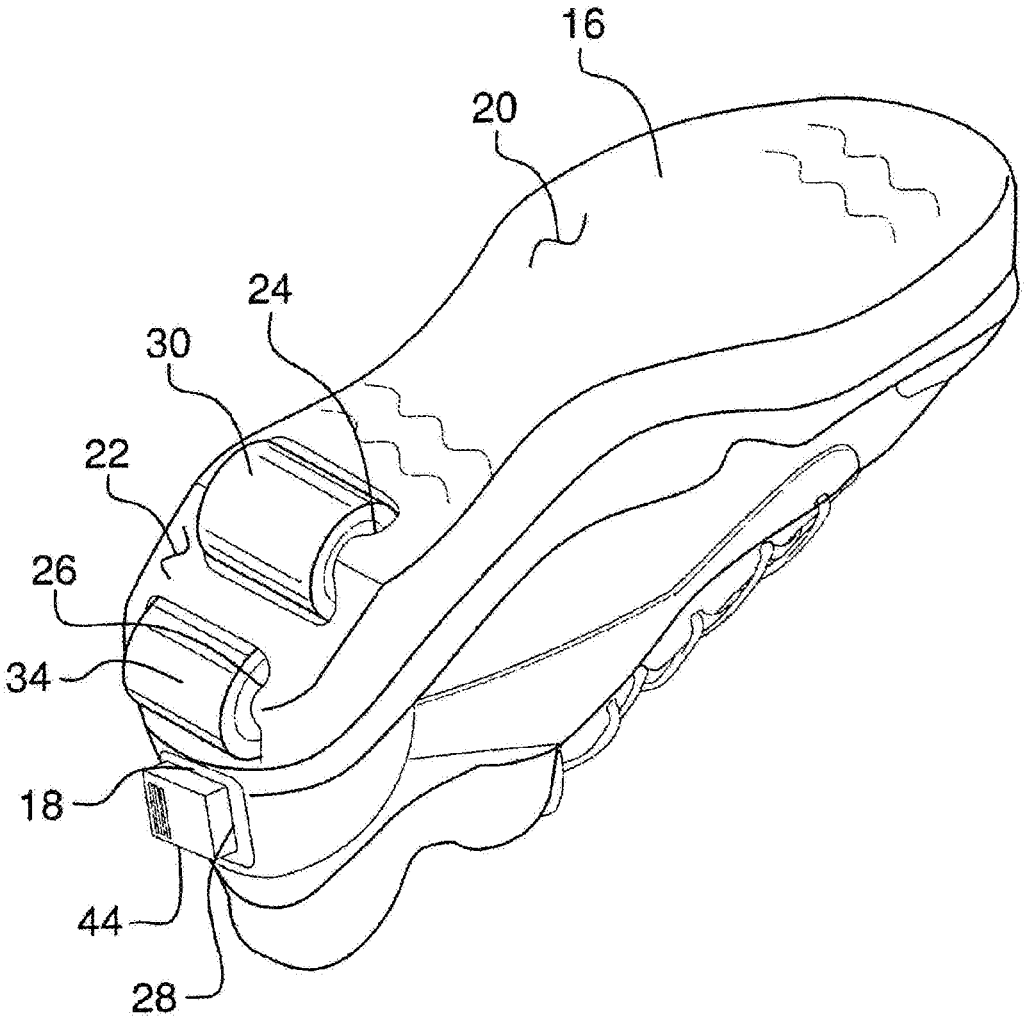
FIG. 1 is a bottom perspective view of a motorized shoe assembly according to an embodiment of the disclosure.

With reference now to the drawings, and in particular to FIGS. 1 through 8 thereof, a new shoe device embodying the principles and concepts of an embodiment of the disclosure and generally designated by the reference numeral 10 will be described.

As best illustrated in FIGS. 1 through 8, the motorized shoe assembly 10 generally comprises an electronic device 12, such as a smart phone or other device that has a transceiver, and the electronic device 12 is carried by a user. A shoe 14 is provided and the shoe 14 is worn on the user's foot. The shoe 14 has a sole 16 and a heel 18, and the sole 16 has a bottom surface 20 and an angled surface 22 angling upwardly between the bottom surface 20 and the heel 18. The bottom surface 20 has a first well 24 extending upwardly therein and the first well 24 is positioned at an intersection between the bottom surface 20 and the angled surface 22. The angled surface 22 has a second well 26 extending inwardly therein and the second well 26 is positioned at an intersection between the angled surface 22 and the heel 18. The heel 18 has third well 28 extending forwardly therein and the third well 28 is positioned above the second well 26. Each of the first 24, second 26 and third 28 wells are centrally positioned on the sole 16 and the first 24, second 26 and third 28 wells are aligned with each other.

A first roller 30 is rotatably coupled to the sole 16 of the shoe 14 for rolling on a support surface 32, such as a floor or the like. The first roller 30 is positioned in the first well 24 such that the first roller 30 extends beyond the bottom surface 20 of the sole 16. Additionally, the first roller 30 engages the support surface 32 when the user walks and the first roller 30 is oriented to roll about a lateral axis of the sole 16. Moreover, the first roller 30 freely rolls in the first well 24 and the first roller 30 may comprise a roller skate wheel 18 or the like.

A second roller 34 is rotatably coupled to the sole 16 of the shoe 14 and the second roller 34 is aligned with the heel 18. The second roller 34 is spaced upwardly from the support surface 32 when the sole 16 rests on the support surface 32. Alternatively, both of the first 30 and second 34 rollers engage the support surface 32 when the shoe 14 is tilted rearwardly on the sole 16. In this way the shoe 14 can roll along the support surface 32 on each of the first 30 and second 34 rollers. The second roller 34 is positioned in the second well 26 such that the second roller 34 extends beyond the angled surface 22 of the sole 16. The second roller 34 is oriented to roll about the lateral axis of the sole 16 and the second roller 34 may comprise a roller skate wheel 18 or the like. Additionally, the angled surface 22 of the sole 16 is oriented parallel to the support surface 32 when each of the first 30 and second 34 rollers engages the support surface 32.

A control circuit 36 is positioned within the shoe 14 and a motor 38 is removably positioned within the shoe 14. The motor 38 is electrically coupled to the control circuit 36 and the motor 38 has a drive shaft 40. The motor 38 rotates the drive shaft 40 when the motor 38 is turned on, the motor 38 is positioned in the third well 28 and the motor 38 may comprise an electrical motor or the like. The motor 38 may be removed from the third well 28 for reducing weight of the shoe 14. Additionally, shock absorbers, such as resiliently compressible pads, hydraulic pistons or other means of absorbing shock, may be integrated into the shoe 14 and the motor 38 may engage the shock absorbers to protect the motor 38 from impact damage.

A gear drive 42 is positioned within the shoe 14 and the gear drive 42 engages the drive shaft 40. Thus, the drive shaft 40 rotates the gear drive 42 when the motor 38 is turned on. The gear drive 42 is coupled to the second roller 34 such that the gear drive 42 rotates the second roller 34 when the motor 38 is turned on. In this way the second roller 34 urges the user along the support surface 32 when the shoe 14 is tilted rearwardly on the sole 16. The gear drive 42 may comprise a planetary gear, a plurality of mitre gears or any other conventional type of right angle gears. Moreover, the second roller 34 freely rotates when the motor 38 is turned off or when the second roller 34 is not being actively rotated by the motor 38 while the motor 38 is turned on.

A cover 44 is removably coupled to the heel 18 and the cover 44 is positioned over the third well 28. The cover 44 forms a fluid impermeable seal with the heel 18, through a gasket or the like, thereby protecting the motor 38 from fluid and dust. A receiver 46 is positioned within the shoe 14 and the receiver 46 is electrically coupled to the control circuit 36. Moreover, the receiver 46 is in wireless electrical communication with the electronic device 12. The receiver 46 receives a control signal from the electronic device 12 for remotely turning the motor 38 on and off. The receiver 46 may be a radio frequency receiver that employs Bluetooth communication protocols.

A power supply 48 is positioned in the shoe 14, the power supply 48 is electrically coupled to the control circuit 36 and the power supply 48 comprises at least one battery. A pair of the shoes 14, and all of the attendant components, is provided for wearing. A shock absorber 49 is positioned within the shoe 14 and the power supply 48 engages the shock absorber 49. The shock absorber 49 absorbs impact energy thereby protecting the power supply 48 from vibration and the like. The shock absorber 49 may be a resiliently compressible member, a hydro-mechanical shock absorber or any other type of shock absorber.

Figure 2:
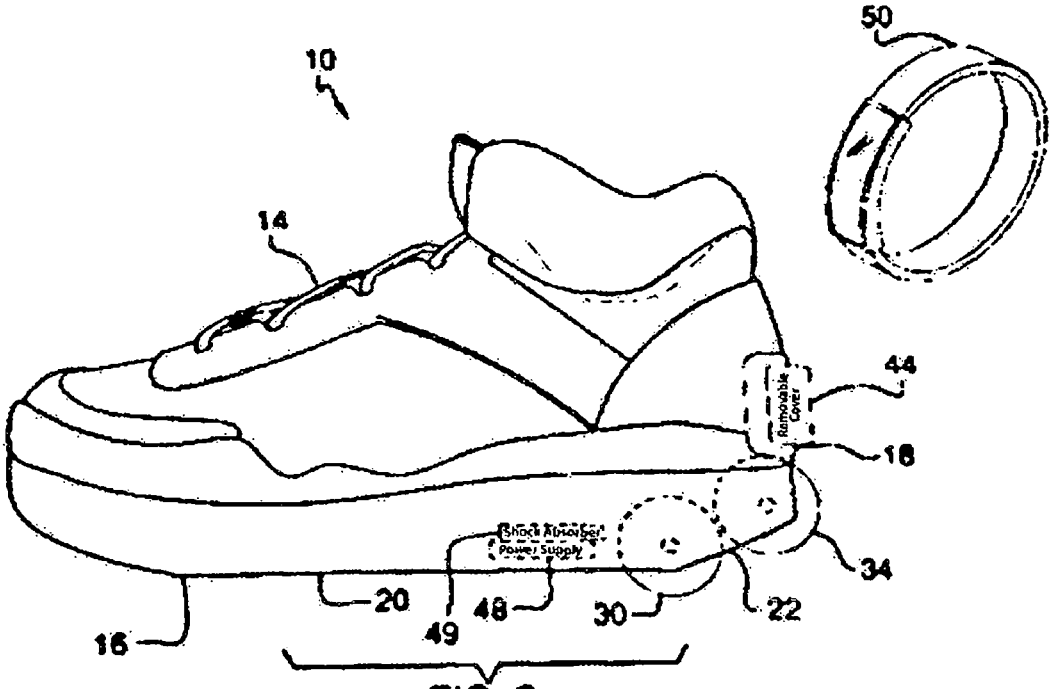
FIG. 2 is a left side phantom view of an embodiment of the disclosure.
Figure 3:
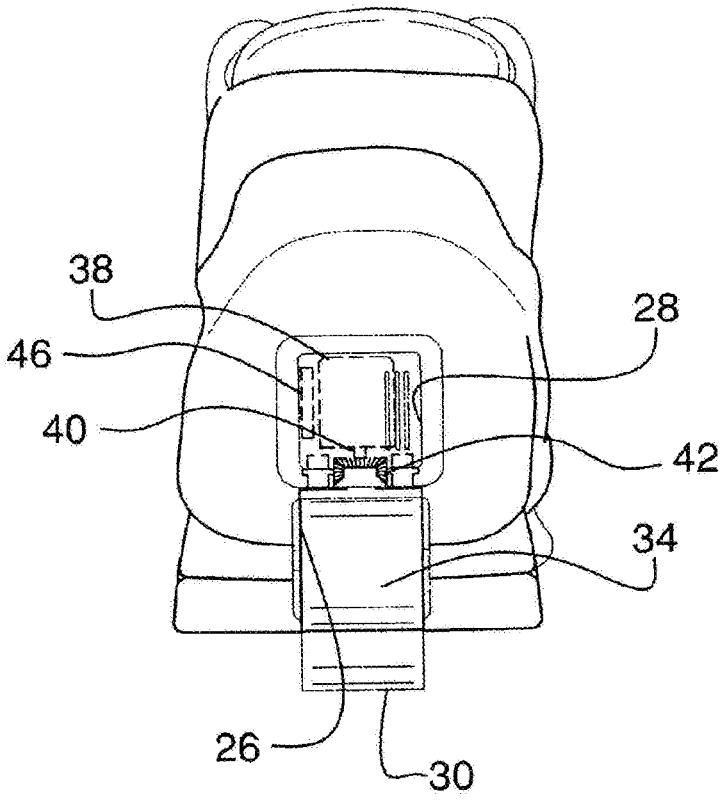
FIG. 3 is a back phantom view of an embodiment of the disclosure.
Figure 4:
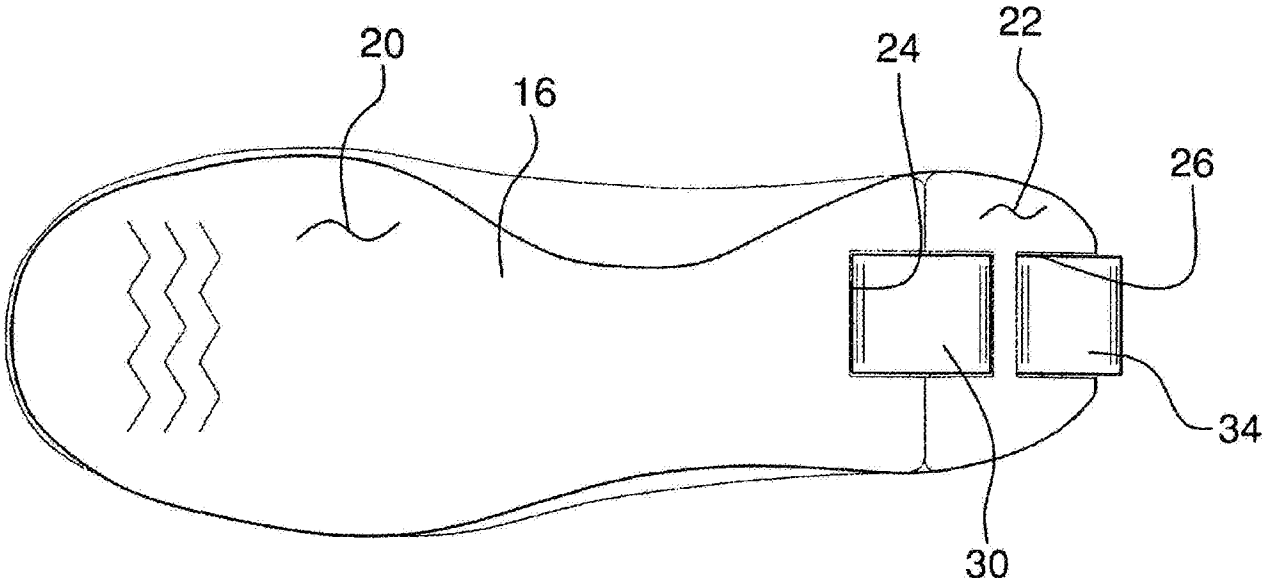
FIG. 4 is a bottom view of an embodiment of the disclosure.
Figure 5:
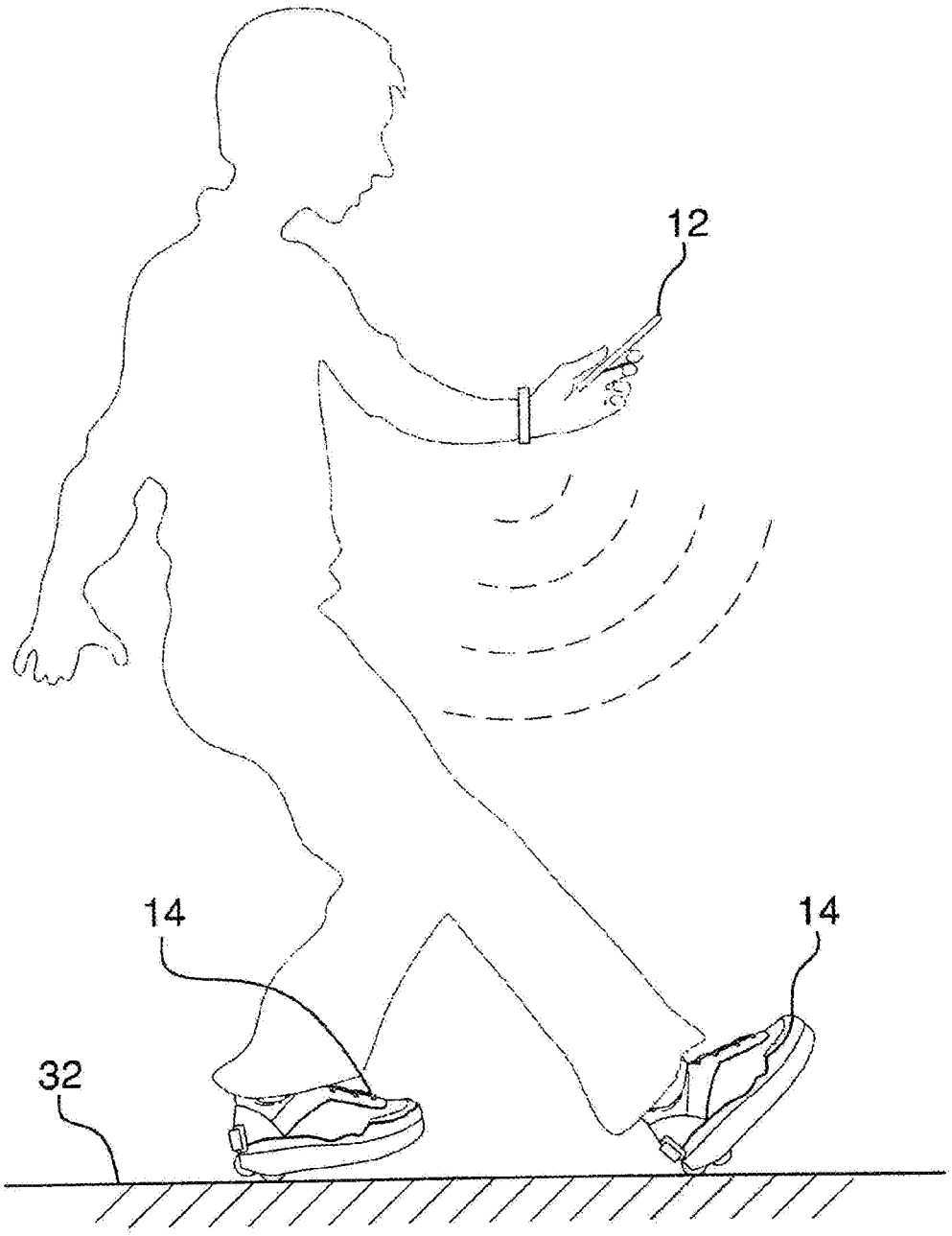
FIG. 5 is a perspective in-use view of an embodiment of the disclosure.
Figure 6:
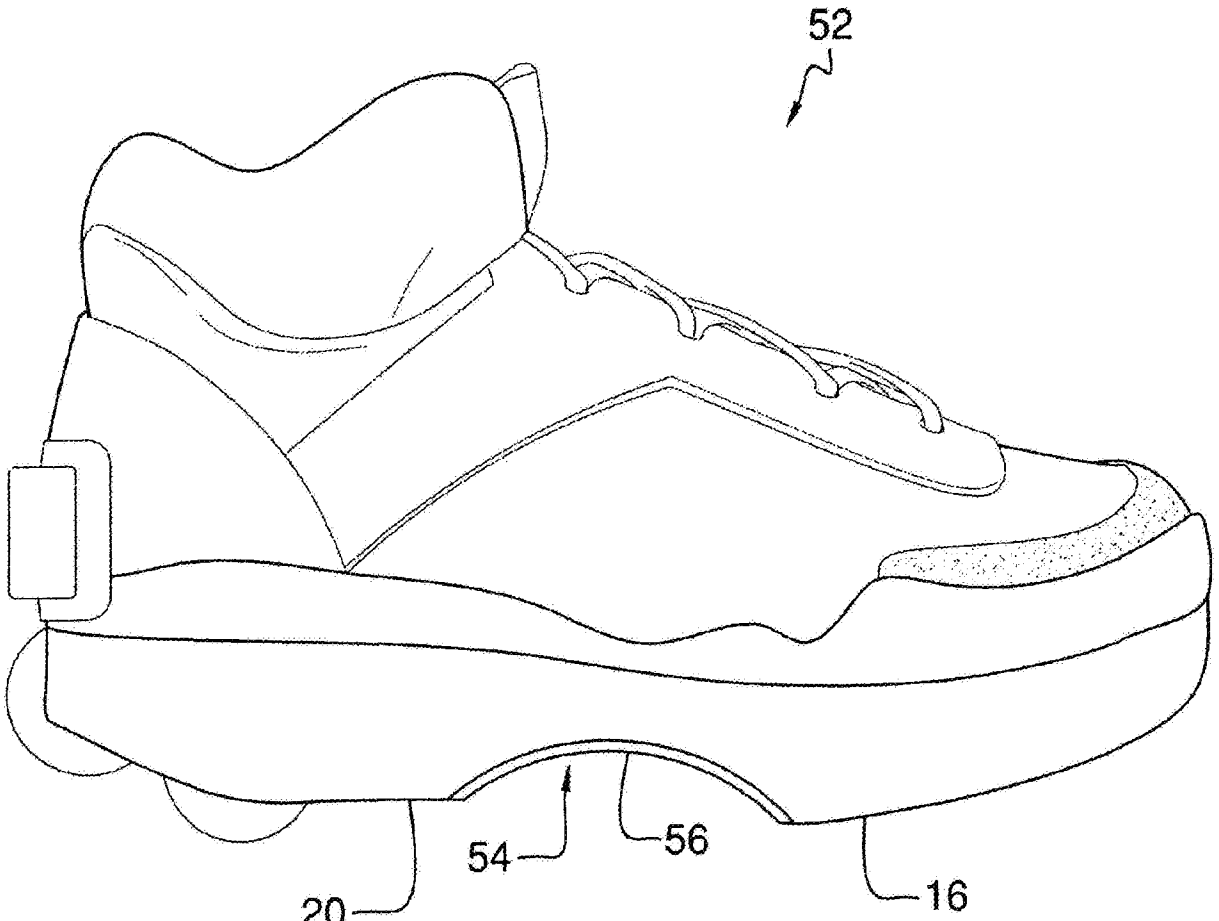
FIG. 6 is a perspective view on an alternative embodiment of the disclosure.
Figure 7:
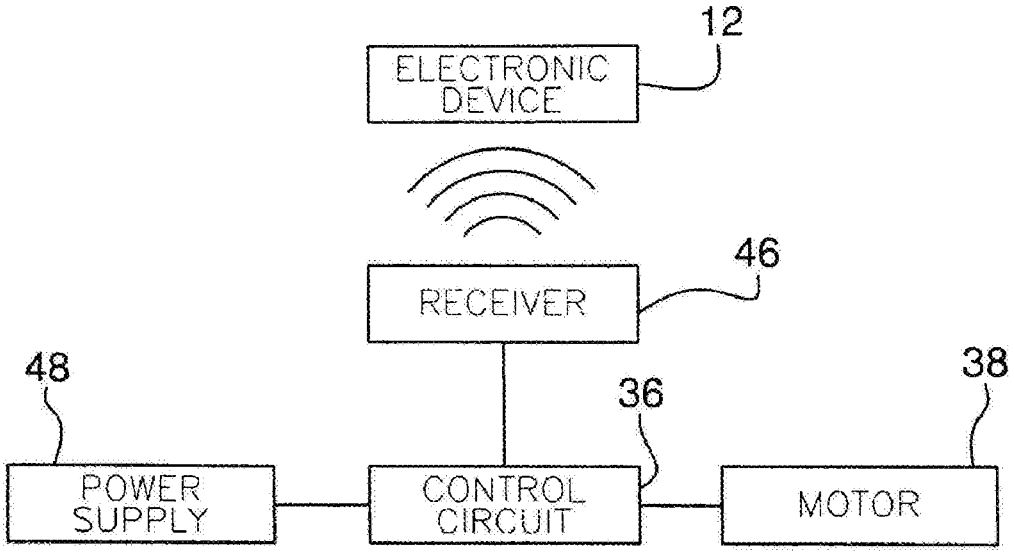
FIG. 7 is a schematic view of an embodiment of the disclosure.

As shown in FIG. 2, a bracelet 50 may be provided that includes a remote control for remotely controlling the motor 38 in lieu of the electronic device 12. In an alternative embodiment 52 as shown in FIG. 6, the bottom surface 20 of the sole 16 may have a slot 54 extending laterally across the sole 16. The slot 54 may have a bounding surface 56 and the bounding surface 56 may be concavely arcuate with respect to the bottom surface 20 of the sole 16. Thus, the slot 54 may accommodate a rail for sliding along the rail thereby facilitating rail grinding in the convention of skateboarding.

Figure 8:
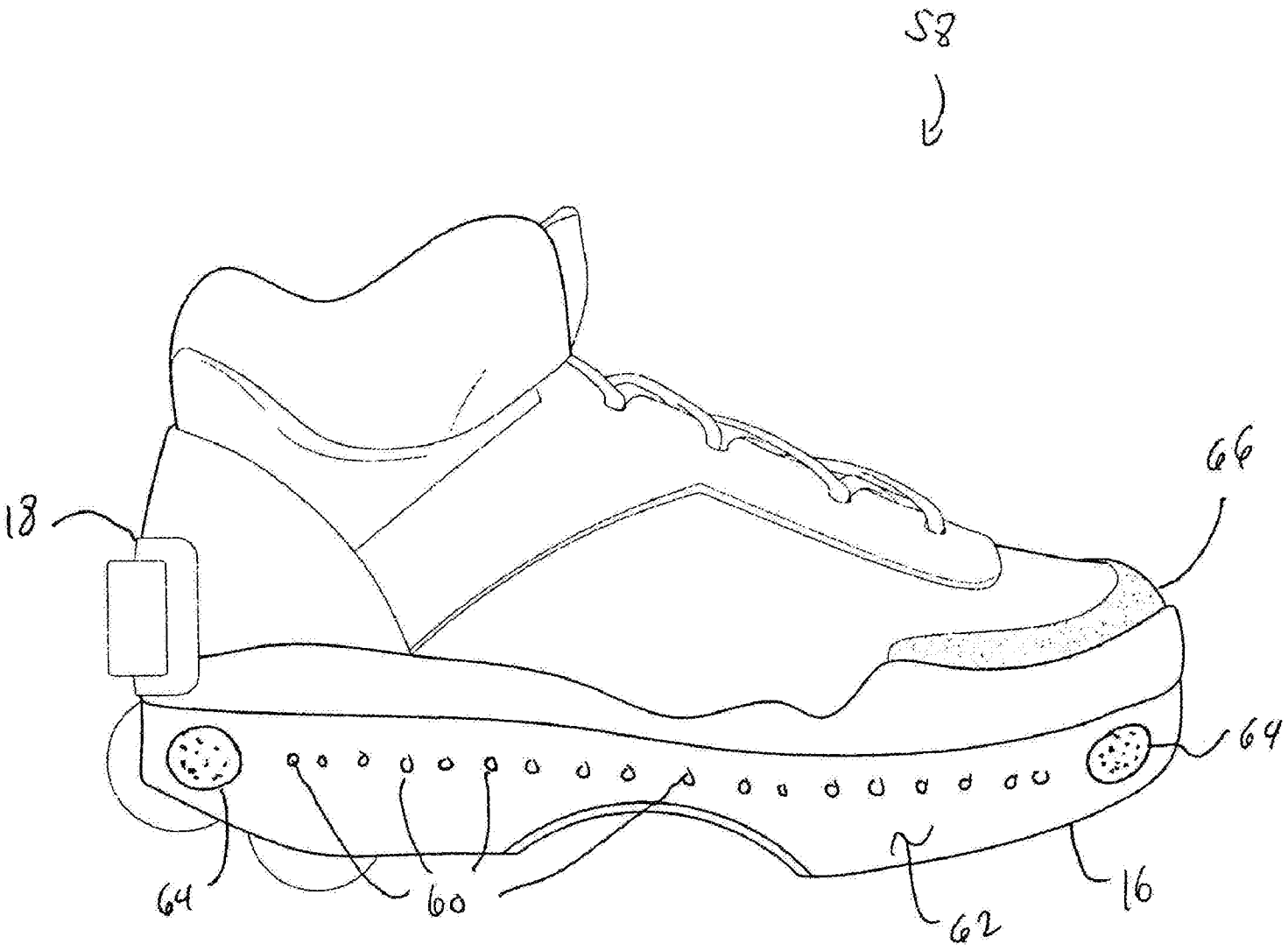
FIG. 8 is a right side view of an alternative embodiment of the disclosure.

In an alternative embodiment 58 as shown in FIG. 8, a plurality of light emitters 60 may be coupled to the shoe 14 and the light emitters 60 may be distributed along an outward facing surface 62 of the sole 16. Each of the light emitters emits light when the light emitters are turned on for enhancing the ornamental appeal of the shoe. Each of the light emitters 60 may be electrically coupled to the control circuit 36. Continuing in the alternative embodiment 58 according to FIG. 8, a speaker 64 may be coupled to the outward facing surface 62 of the sole 16 for emitting audible sounds outwardly therefrom. The speaker 64 may be electrically coupled to the control circuit 36 for emitting music that is received from a remote electronic device via the receiver 46. Additionally, a pair of the speakers 64 may be provided and each of the speakers 64 may be positioned adjacent to a respective one of the heel 18 of the shoe 16 and a toe 66 of the shoe 16.

In use, the shoes 14 are worn for walking in the conventional means of wearing shoes 14. The user tilts each of the shoes 14 rearwardly such that each of the first 30 and second 34 rollers engage the support surface 32. In this way each of the shoes 14 can roll along the support surface 32 instead of walking. The electronic device 12 is manipulated, with an app or other control program, to turn on the motor 38 in each of the shoes 14. Thus, the second roller 34 in each of the shoes 14 is rotated to transport the user along the support surface 32. The user can rock forwardly on the shoes 14 at any time to stop rolling along the support surface 32 and begin walking.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized shoe assembly being configured to transport a user along a support surface, said assembly comprising:

an electronic device adapted to be being carried by a user;

a shoe being configured to be worn on the user's foot, said shoe having a sole and a heel;

a first roller being rotatably coupled to said sole of said shoe for rolling on the support surface;

a second roller being rotatably coupled to said sole of said shoe, said second roller being aligned with said heel, said second roller being spaced upwardly from the support surface when said sole rests on the support surface, both of said first and second rollers engaging the support surface when said shoe is tilted rearwardly on said heel;

a control circuit being positioned within said shoe, said control, circuit being in electrical communication with said electronic device; and a motor being positioned within said shoe, said motor being electrically coupled to said control circuit such that said electronic device remotely controls said motor, said motor being in mechanical communication with said second roller, said motor rotating said second roller when said motor is turned on wherein said second roller is configured to urge the user along the support surface.

2. The assembly according to claim 1, wherein said sole has a bottom surface and an angled surface angling upwardly between said bottom surface and said heel, said bottom surface having a first well extending upwardly therein, said first well being positioned at an intersection between said bottom surface and said angled surface, said angled surface having a second well extending inwardly therein, said second well being positioned at an intersection between said angled surface and said heel, said heel having third well extending forwardly therein, said third well being positioned above said second well.

3. The assembly according to claim 2, wherein:

said first roller is positioned in said first well such that said first roller extends beyond said bottom surface of said sole, said first roller engaging the support surface when the user walks, said first roller being oriented to roll about a lateral axis of said sole; and said second roller is positioned in said second well such that said second roller extends beyond said angled surface of said sole, said second roller being oriented to roll about said lateral axis of said sole.

4. The assembly according to claim 2, further comprising:

said motor having a drive shaft, said motor rotating said drive shaft when said motor is turned on, said motor being positioned on said third well; and a gear drive being positioned within said shoe, said gear drive engaging said drive shaft such that said drive shaft rotates said gear drive when said motor is turned on, said gear drive being coupled to said second roller such that said gear drive rotates said second roller when said motor is turned on.

5. The assembly according to claim 1, further comprising a receiver being positioned within said shoe, said receiver being electrically coupled to said control circuit, said receiver being in wireless electrical communication with said electronic device, said receiver receiving a control signal from said electronic device for remotely turning said motor on and off.

6. The assembly according to claim 1, further comprising a power supply being positioned in said shoe, said power supply being electrically coupled to said control circuit, said power supply comprising at least one battery.

7. A motorized shoe assembly being configured to transport a user along a support surface, said assembly comprising:

an electronic device adapted to be being carried by a user;

a shoe being configured to be worn on the user's foot, said shoe having a sole and a heel, said sole having a bottom surface, and an angled surface angling upwardly between said bottom surface and said heel, said bottom surface having a first well extending upwardly therein, said first well being positioned at an intersection between said bottom surface and said angled surface, said angled surface having a second well extending inwardly therein, said second well being positioned at an intersection between said angled surface and said heel, said heel having third well extending forwardly therein, said third well being positioned above said second well;

a first roller being rotatably coupled to said sole of said shoe for rolling on the support surface, said first roller being positioned in said first well such that said first roller extends beyond said bottom surface of said sole, said first roller engaging the support surface when the user walks, said first roller being oriented to roll about a lateral axis of said sole;

a second roller being rotatably coupled to said sole of said shoe, said second roller being aligned with said heel, said second roller being spaced upwardly from the support surface when said sole rests on the support surface, both of said first and second rollers engaging the support surface when said shoe is tilted rearwardly on said heel, said second roller being positioned in said second well such that said second roller extends beyond said angled surface of said sole, said second roller being oriented to roll about said lateral axis of said sole;

a control circuit being positioned within said shoe;

a motor being positioned within said shoe, said motor being electrically coupled to said control circuit, said motor having a drive shaft, said motor rotating said drive shaft when said motor is turned on, said motor being positioned on said third well;

a gear drive being positioned within said shoe, said gear drive engaging said drive shaft such that said drive shaft rotates said gear drive when said motor is turned on, said gear drive being coupled to said second roller such that said gear drive rotates said second roller when said motor is turned on wherein said second roller is configured to urge the user along the support surface;

a receiver being positioned within said shoe, said receiver being electrically coupled to said control circuit, said receiver being in wireless electrical communication with said electronic device, said receiver receiving a control signal from said electronic device for remotely turning said motor on and off; and a power supply being positioned in said shoe, said power supply being electrically coupled to said control circuit, said power supply comprising at least one battery.

* * * * *